United States Patent [19]

Saito et al.

[11] Patent Number: 5,007,209

[45] Date of Patent: Apr. 16, 1991

[54] OPTICAL FIBER CONNECTOR POLISHING APPARATUS AND METHOD

[75] Inventors: Kazuharu Saito; Hiroyasu Matsukura; Hiroshi Komase; Haruhiro Tsuneda, all of Nagano; Junji Watanabe, Tokyo; Tadao Saito, Tokyo; Toshiroh Doy, Tokyo; Kazuo Matsunaga, Tokyo, all of Japan

[73] Assignees: K.K. Sankyo Seiki Seisakusho, Nagano; Nippon T&T Corp., Tokyo, both of Japan

[21] Appl. No.: 296,729

[22] Filed: Jan. 13, 1989

[30] Foreign Application Priority Data

Jun. 26, 1987 [JP] Japan ..... 62-159126
Jan. 14, 1988 [JP] Japan ..... 63-6483
Jan. 22, 1988 [JP] Japan ..... 63-12157

[51] Int. Cl.[5] ..... B24B 19/00

[52] U.S. Cl. ..... 51/283 R; 51/128; 51/131.1; 51/131.3

[58] Field of Search ..... 51/281 R, 283 R, 124 R, 51/125.5, 125, 131.1, 131.3, 131.2

[56] References Cited

U.S. PATENT DOCUMENTS 4,291,502 9/1981 Grimsby et al. ..... 51/128
4,587,768 5/1986 Doyle ..... 51/124 R
4,653,233 3/1987 Brueck ..... 51/125.5
4,831,784 5/1989 Takahashi ..... 51/131.1
4,839,993 6/1989 Masuko et al. ..... 51/124 R

FOREIGN PATENT DOCUMENTS 127656 8/1982 Japan ..... 51/283 R
0645763 1/1989 Japan .

*Primary Examiner*—Frederick R. Schmidt
*Assistant Examiner*—Blynn Shideler
*Attorney, Agent, or Firm*—Sughrue, Mion, Zinn, Macpek & Seas

[57] ABSTRACT

An optical fiber connector polishing apparatus is disclosed which comprises a polishing element rotated at high speed, a chuck for supporting an optical fiber connector in such a manner that the optical fiber connector is rotatable in a reciprocation mode, a swing arm which holds the chuck to swing the chuck, in a horizontal plane, between a first fixed position and a second fixed position, a positioning unit for positioning the swing arm selectively at the first or second fixed position on the swing locus thereof, a swinging unit for swinging the swing arm in a horizontal plane continuously while the end portion of the optical fiber connector being polished with the polishing element, and a reference member for positioning the end portion of the optical fiber connector at a reference position. The polishing element and the reference member are arranged at the first and second fixed positions of the swing arm, respectively. After, at the second fixed position, the end portion of the optical fiber connector is positioned with the reference member, the swing arm are moved to the first fixed position to polish the end portion of the optical fiber with the polishing element.

8 Claims, 7 Drawing Sheets

OPTICAL FIBER CONNECTOR POLISHING APPARATUS AND METHOD

BACKGROUND OF THE INVENTION

This invention relates to an improvement of an apparatus for polishing the end face of an optical fiber connector.

An optical fiber connector is used to optionally join two optical fibers in the field of optical communications or optical sensors. In joining the optical fibers, the end face of each optical fiber is machined into a substantially convex surface at the work site, in order to minimize the optical loss of joint. In this case, the optical fiber connector is polished as follows: First, the end face of the optical fiber connector is polished into a conical surface, and then the vertex portion of the conical surface is polished into a spherical surface.

Such an optical fiber connector polishing apparatus has been disclosed, for instance, by Japanese patent application (OPI) No. 34762/1987 (the term "OPI" as used herein means an "unexamined published application"). In the apparatus, while a polishing plate is being rotated at high speed, an optical fiber connector is swung in a reciprocation mode while being rotated. However, the conventional apparatus is a theoretical one having no functions which are required for practical use.

When the polishing apparatus of this type is used at the site of installation, it is essential that the apparatus is small in size and light in weight, that is, it is high in portability, and it can polish optical fiber connectors with high precision, and that a drive source can be readily obtained for it.

Japanese patent application (OPI) No. 192460/1986 has proposed a convex surface polishing method in which an optical fiber connector rotating in a reciprocation mode, while being pushed against a elastic polishing board rotating at high speed, is swung along the polishing surface. However, the method is merely theoretical, not proposing an apparatus for practicing it.

In addition, the above-described conventional polishing apparatus has almost all the functions necessary for practical use; however, it is still disadvantageous in that the optical fiber connectors polished thereby are not uniform in spherical radius, in centering, and in length; that is, the apparatus is not stable in polishing accuracy.

OBJECTS AND SUMMARY OF THE INVENTION

Accordingly, a first object of this invention is to provide an optical fiber connector polishing method which satisfies the above-described requirements, and an apparatus for practicing the method which is excellent in portability, and uses a commercial electric power source to obtain all motions necessary for polishing an optical fiber connector with high accuracy.

A second object of the invention is to minimize the fluctuations in spherical radius, in centering and in length of the optical fiber connectors machined; i.e., to polish the end faces of optical fiber connectors uniformly and accurately, thereby to provide optical fibers connectors high in quality.

In the invention, a polishing element is rotated at high speed by an electric motor, and an optical fiber connector is fitted in a chunk provided on a support. While the chuck is rotated through at least 360° in a reciprocation mode, the support is swung repeatedly in a plane parallel with the polishing surface of the polishing element, to move the optical fiber connector as required for polishing it.

Of the compound motions thus provided, the rotation of the polishing element and the swing of the support are mechanically carried out in synchronization with each other during the transmission of one and the same torque. Therefore, with the polishing apparatus of the invention, the spherical polishing of the end faces of a number of optical connectors can be achieved with high stability and with high accuracy.

In the invention, an optical fiber connector to be polished is supported on a swing arm, and with the end portion of the optical fiber connector pushed against the polishing element rotating at high speed, the optical fiber connector is reciprocated along the polishing surface of the polishing element while being rotated in a reciprocation mode, and in fitting the optical fiber connector in the chuck of the swing arm, a regulating means is utilized so that the optical fiber connector is positioned relative to the polishing surface of the polishing element. The swing arm has a positioning means at the center of the swing, which allows it to position at a first fixed position or a second fixed position; when the swing arm is set at the first position, it confronts with the polishing element, and, when set at the second position, it confronts with the regulating means for positioning the optical fiber connector, and the optical fiber connector is held.

Thus, the optical fiber connector, fitted in the chuck of the swing arm, is positioned along the direction of axis of the optical fiber; that is, it is accurately positioned with respect to the polishing surface of the polishing element. Hence, the end portions of optical fiber connectors polished with the polishing apparatus of the invention are uniform in dimension; that is, the polishing apparatus of the invention can polish optical fiber connectors with high accuracy.

DETAILED DESCRIPTION OF THE PREFERRED EMBODIMENTS

Figure 1:
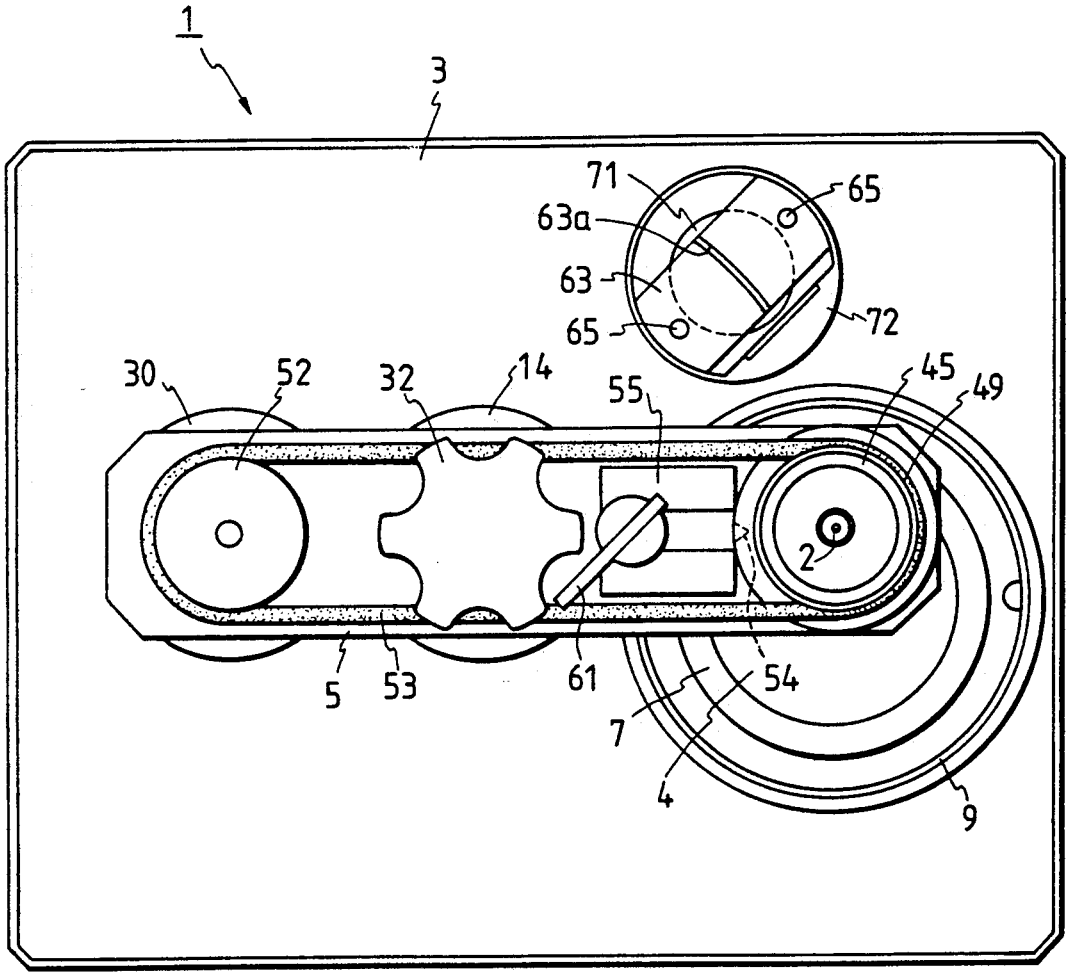
FIG. 1 is a plan view showing one example of an optical fiber connector polishing apparatus according to this invention.

FIGS. 1 through 4 shows the entire arrangement of an optical fiber connector polishing apparatus 1 according to this invention.

The polishing apparatus 1 has a frame 3 supporting a polishing element 4 and a swing arm 5 for polishing an optical fiber connector 2. The polishing element 4 is fixedly held by an annular fixing member 7 on a cup-shaped rotor 6. The rotor 6 is provided in a cover 9 forming a polishing chamber, and is rotatably supported on the frame 3 by means of a vertical rotary shaft 10, upper and lower bearings 11, and a bearing cylinder 12. The cover 9 together with a polishing solution receiving plate 8 is fixedly secured by a bearing retainer 13 provided on the bearing cylinder 12.

The frame 3 is mounted on a box-shaped casing 15 in which an electric motor 16 is accommodated. The rotation of the motor 16 is transmitted to the rotor 6 through a pulley 17 mounted on the output shaft of the motor 16, a pulley 18 mounted on the other end portion of the rotary shaft 10, and an endless belt 19 laid over these pulleys 17 and 18. The rotation of the rotor 6 is transmitted through a worm 20 coupled thereto and a worm wheel 21 mounted on an intermediate shaft 22 to a rocking cam 23 mounted on the intermediate shaft 22, and through a roller 24 in contact with the cam 23 to a driven rod 25 laid horizontally. One end portion of the worm 20 and both end portions of the intermediate shaft 22 are rotatably supported on the frame 3 respectively through a bearing 26 and bearings 27 and 27. The driven rod 25 is inserted into a guide cylinder 28 forming a part of the frame 3, in such a manner that the rod 25 is axially slidable but not rotatable.

The swing arm 5 mentioned above is laid horizontal. The swing arm 5 has a chuck 29 at the front end above the polishing element 4, and a reversible motor 30 such as a stepping motor at the rear end. The swing arm 5 is rotatably mounted on the upper end portion of a swing fulcrum shaft 31 extended vertically; more specifically, the upper end portion of the swing fulcrum shaft 31 penetrates the swing arm 5 at its center of gravity. The swing arm 5 is urged upwardly by a coiled spring 38, and is coupled to the swing fulcrum shaft 31 with a screw type knob 32. The swing fulcrum shaft 31 together with a bearing retainer 14 is rotatably supported through upper and lower bearings 34 on a bearing housing 34 forming a part of the frame 3. A swing lever 35 is fixedly mounted on the lower end portion of the swing fulcrum shaft 31, and a tension spring 36 is connected between the swing lever 35 and the frame 3 so that the swing fulcrum shaft 31 contacts through the swing lever 35, the end of the driven rod 25.

Figure 2:
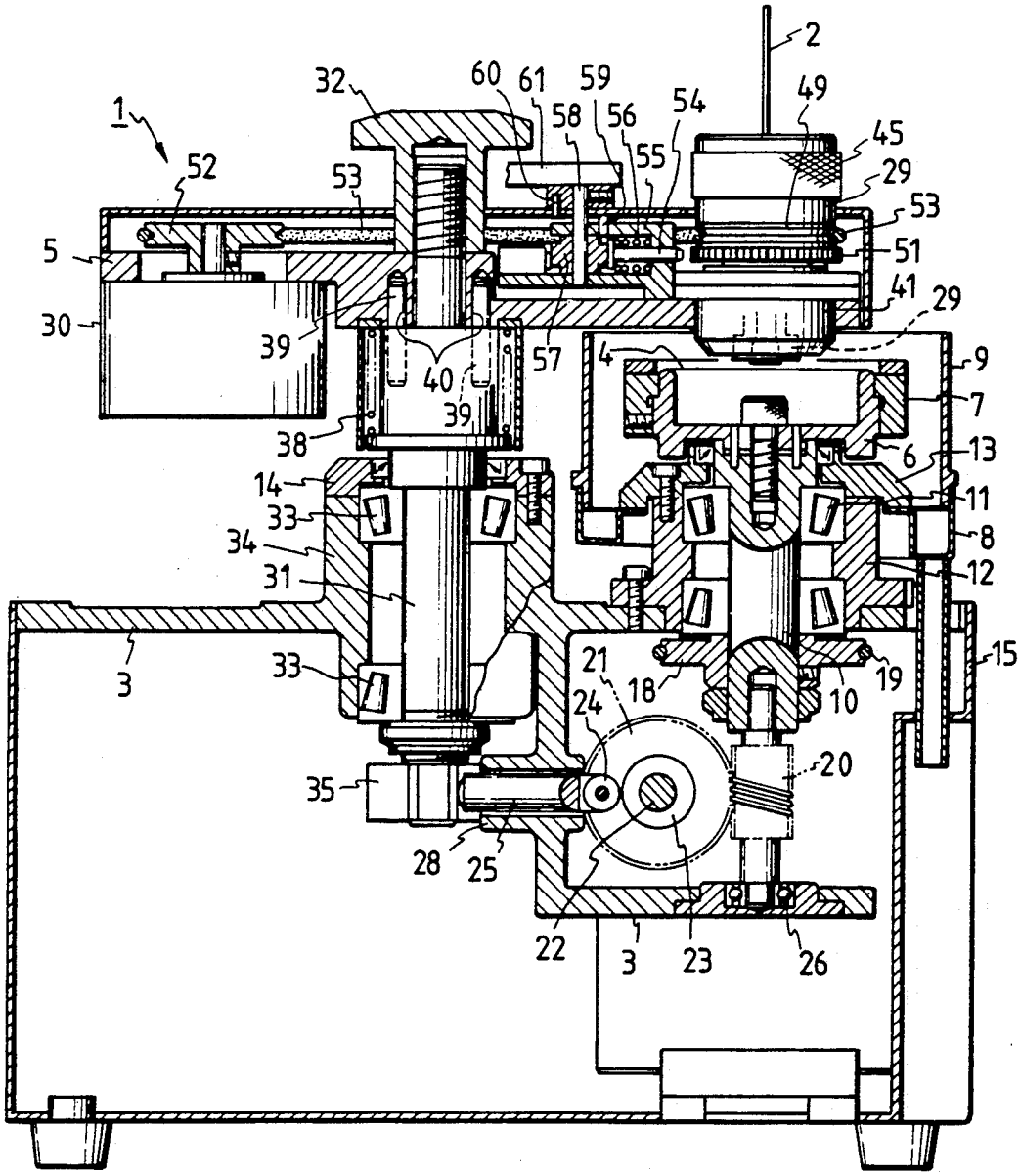
FIG. 2 is a vertical sectional view taken along the central vertical axis of the apparatus.
Figure 5:
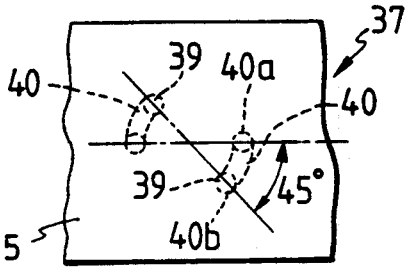
FIG. 5 is a plan view showing essential components of a positioning means.
Figure 6:
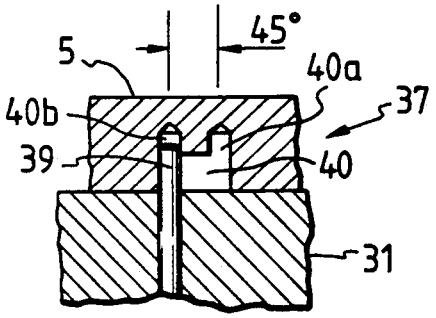
FIG. 6 is an explanatory sectional diagram showing a positioning groove.

As shown in FIGS. 2, 5 and 6, two positioning pins 39 are provided in parallel with the swing fulcrum arm 31, and two arcuate positionig grooves 40 each having a cental angle of 45° are formed in the swing arm 5. The swing arm 5 is engaged with the pins 39 through the grooves 40 in such a manner that they are swingable about the swing fulcrum shaft 31 through 45° in a horizontal plane and can be fixed being engaged with fixing holes 40*a* and 40*b* at both ends of each groove 40. The positioning pins 39, and the positioning grooves 40 form a swing arm (5) positioning means 37.

Figure 7:
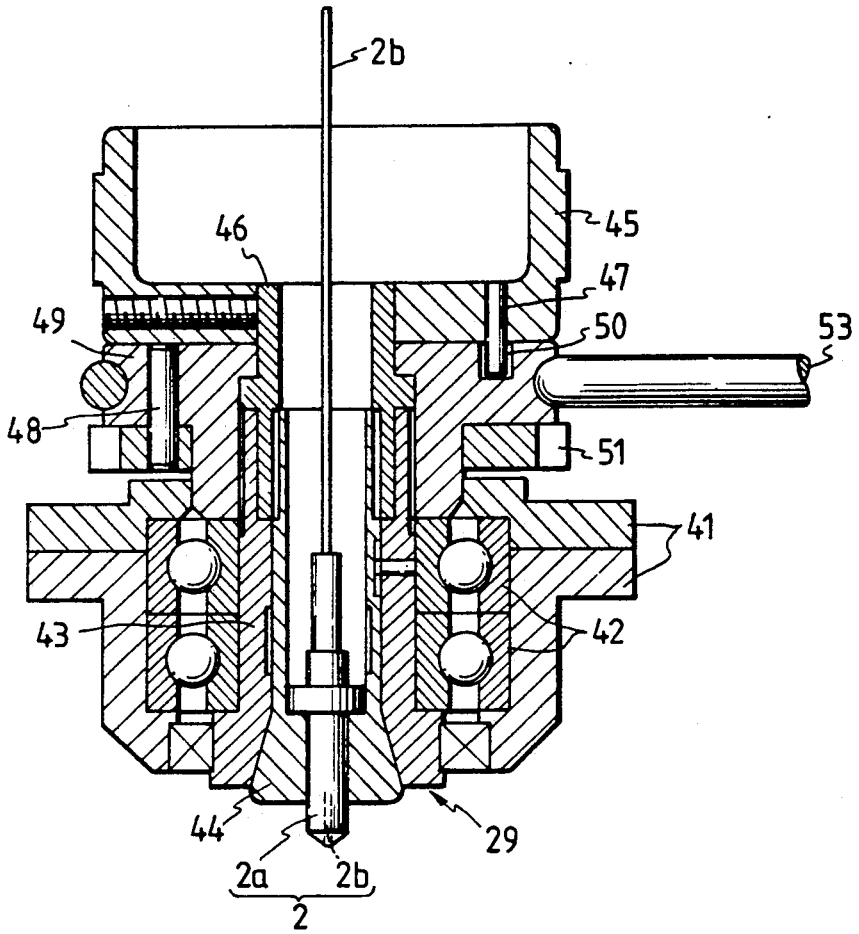
FIG. 7 is an enlarged vertical sectional diagram showing a part of a chuck.

The chuck 29, as shown in FIG. 7, is held vertical; more specifically, it is rotatably supported through bearings 42 in the upper and lower housings 41 which are secured to the swing arm 5. The chuck 29 is, for instance, of collet type, comprising a collet sleeve 43 supported by the bearings 42, and a collet 44 provided in the collet sleeve 43 in such a manner that it is not rotatable, but movable axially. The upper end portion of the collet 44 is coupled to a clamp nut 46 integral with a collet locking dial 45 by screw pair, so that, as the collet 44 is moved axially to hold or release an optical fiber connector (comprising a ferrule 2*a* and optical fiber 2*b*) to be polished. The range of rotation of the dial 45 is limited by a regulating pin 47 and a stopper 48; that is, the rotation of the dial 45 is stopped when the regulating pin 47 moving along an annular groove 50 formed in a pulley 49 abuts against the stopper 48. The upper end portion of the collet sleeve 43 are threadably engaged with a gear-shaped lock wheel 51 and the pulley 49. An endless belt 53 is laid over the pulley 49 and a pulley 52 coupled to the motor 30 so that the pulley 49 is driven in a reciprocation mode by the motor 30.

The lock wheel 51, as shown in FIG. 2, is so designed that the teeth is engageable with a lock pin 54. The lock pin 54 is supported by a holder 55 provided on the swing arm 5 in such a manner that it is movable axially, and it is urged backwardly by a spring 56 provided in the holder 55 so that its rear end is abutted against an eccentric cam 57. The eccentric cam 57 is fixedly mounted on a cam shaft 58, and it is turned with a handle 61 in the range of rotational angles determined by stoppers pins 59 and 60.

Figure 3:
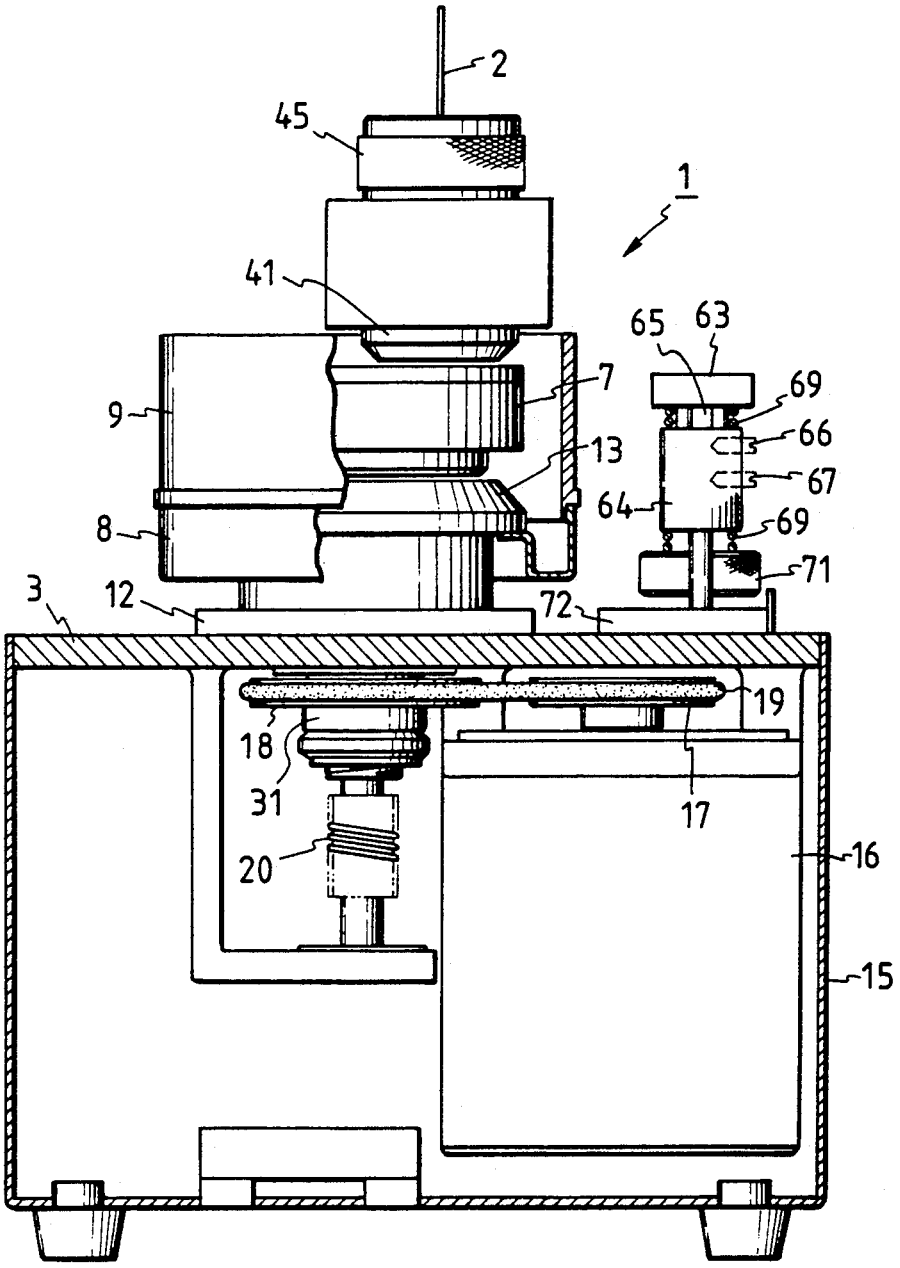
FIG. 3 is a vertical sectional view of the apparatus as viewed in a direction different from that in FIG. 2.
Figure 4:
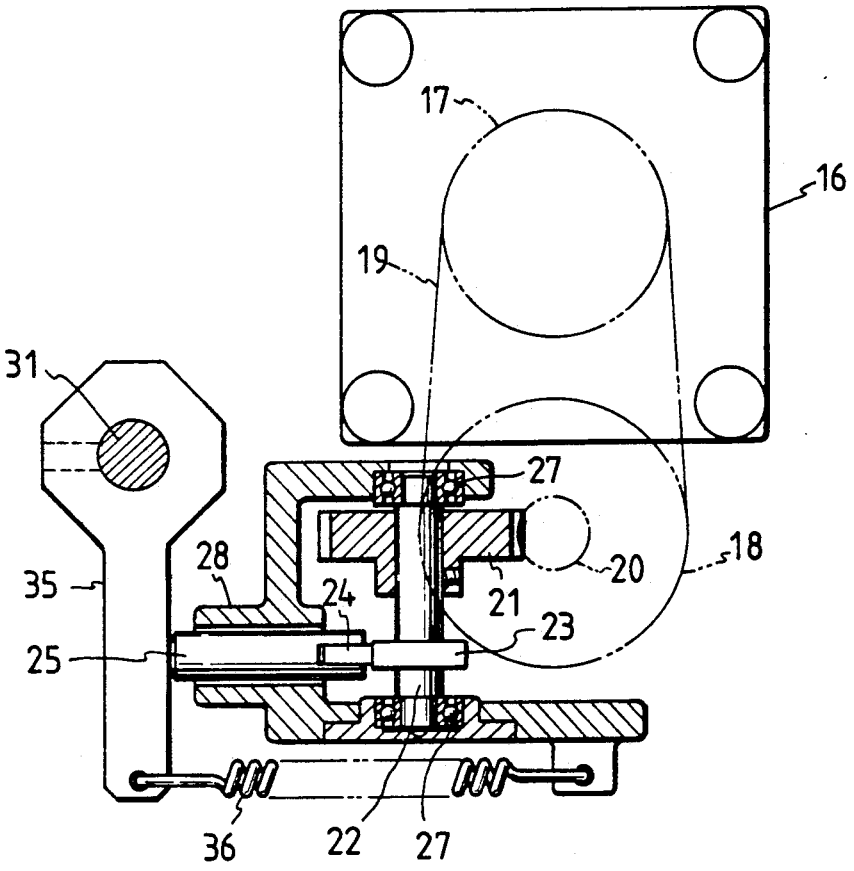
FIG. 4 is a horizontal sectional view showing a part of a cam mechanism in the apparatus of the invention.
Figure 8:
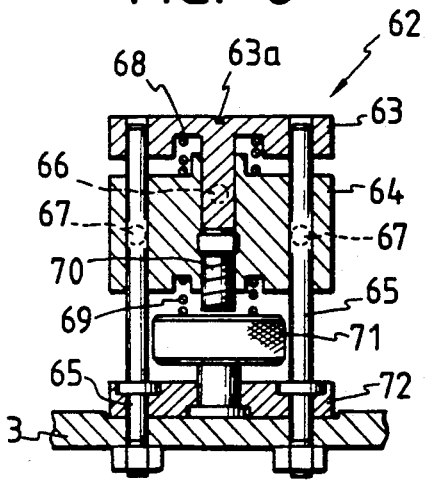
FIG. 8 is a vertical sectional view of a regulating means.

The swing arm 5 is confronted with the rotor 4 when it is at one of the fixed positions of the swing angle of 45° defined by the positioning means 37, and it is confronted with regulating means 62 when at the other fixed position. The regulating means 62, as shown in FIGS. 1, 3 and 8, comprises: a reference member 63, a support 64, and parallel guide bars 65 supporting the reference member 63 and the support 64. The two guide bars 65 are secured through a base plate 72 to the frame 3 in such a manner that they are extended vertical, and are inserted into the holes formed in the reference member 63 and the support 64, thus supporting the latter 63 and 64 vertically movably. The central portion of the reference member 63 is engaged with the central hole of the support 64. The reference member 63 and the support 64 are urged to move them away from each by a coiled spring 68 interposed therebetween. The central portion of the reference member 63 may be secured to the support 63 with a fixing screw 66. The support 64 is coupled to a threaded shaft 70 by screw pair, and is urged upwardly by a coiled spring 69. The support 64 can be secured to the guide bars with two fixing screws 67 in such a manner that it is positioned at a predetermined height. The threaded shaft 70 is rotatably engaged with the base plate 72 on the frame 32. The coiled spring 69 uses as a spring seat an adjusting knob for operating the threaded shaft 70.

In an initial adjusting step, the positioning member 63 is positioned at a predetermined height. That is, the operator operates the handle 61 to cause the lock pin 54 to engage with the teeth of the lock wheel 51 thereby to prevent the rotation of the chuck 29. Under this condition, a model workpiece (which is a finished optical fiber connector 2) is inserted into the chuck 29, and the dial 45 is turned so that the collet 44 chucks the workpiece at a predetermined position. In this operation, the chuck 29 is above the polishing element 4, and the lower end of the model workpiece thus chucked is in contact with the upper surface of the polishing element 4.

Thereafter, the operator loosens the knob 32. As a result, the swing arm 5 is raised by the coiled spring 38, and disengaged from the positioning pins 39 at the fixing holes 40*a*. Therefore, the swing arm 5 can turn about the swing fulcrum shaft 31 through 45° in a horizontal plane. Under this condition, the operator turns the swing arm 5 through 45° counterclockwise in FIG. 5 so as to position the chuck 29 above the reference member 63, and tightens the knob 32 so as to engage the positioning pins 39 with the fixing holes 40*b* thereby to fixedly hold the swing arm 5 there. As was described above, the angle of rotation of the swing arm 5 is set to 45° by the engagement of the positioning pins 39 with the fixing holes 40*a* and 40*b* of the positioning grooves 40. Therefore, the swing arm can be positioned with high accuracy.

Before the swing arm is turned in this manner, the reference member 63 has been positioned lower than the polishing element 4. Therefore, when the operator loosens the fixing screw 66 of the reference member 63, the latter 63 is raised by elastic force of the spring 68 until striking against the lower end of the model workpiece. A clearance groove 63*a* is formed in the upper surface of the reference member 63 so that latter may not be brought into contact with the optical fiber 2*b* of the optical fiber connector 2. Under this condition, the fixing screws 66 of the reference member 63 are tightened, so that the upper surface of the reference member 63 is made flush with the upper surface of the polishing element 4, i.e., the polishing surface. Thereafter, the operator turns the adjusting knob 71 to lower the reference member 63 as much as a distance corresponding to the amount of polishing, and then tightens the fixing screws so that the reference member 63 and the support 64 are fixedly secured to the two guide bars 65. Thus, the regulating means 62 has been positioned. Under this condition, the model workpiece is disconnected from the chuck 29.

Figure 9:
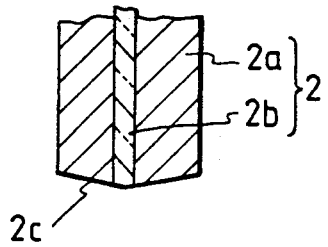
FIG. 9 is an enlarged sectional view of the end portion of an optical fiber connector to be machined.
Figure 10:
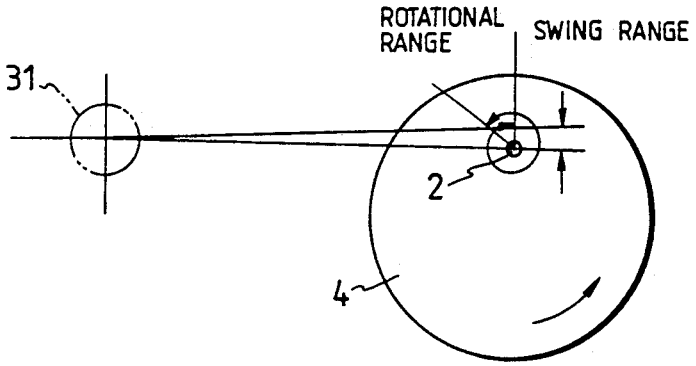
FIG. 10 is an explanatory diagram for a description of the rotation of a polishing element and the reciprocating swing of a swing arm.
Figure 11:
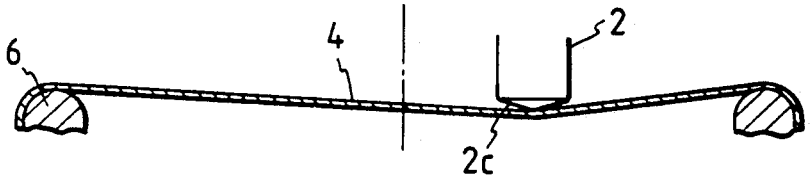
FIG. 11 is an explanatory diagram for a description of the polishing of the optical fiber connector with the polishing element.

Now, polishing an optical fiber connector 2 to be machined can be started. The optical fiber connector 2, as shown in FIG. 9, comprises: a ferrule 2*a*; and an optical fiber 2*b* extended along the central axis of the ferrule 2*a*. The ferrule 2*a* and the optical fiber 2*b* are bonded together with adhesive. The end face of the optical fiber connected, which is to be machined, is a conical surface 2*c*.

After the chuck 29 has been confronted with the reference member 63, the optical fiber connector 2 is inserted into the chuck 29, and is then chucked with the conical surface 2*c* abutted against the upper surface of the reference member 63, and is so secured as to have a predetermined height. Thereafter, the operator loosens the knob 32 and swings the arm 5 so as to position the chuck 29 above the polishing element 4. Under this condition, the knob 32 is tightened to fixedly secure the swing arm 5 to the swing fulcrum shaft 31. In this case also, the swing arm is accurately positioned because the angle of rotation of the swing arm 5 is set to 45° by the engagement of the positioning pins 39 with the fixing holes 40*a* and 40*b* at both ends of the positioning grooves 40. Thus, the conical surface 2*c* of the optical fiber connector 2 has been pushed against the upper surface of the polishing element 4. Thereafter, the operator starts the two motors 16 and 30 with the chuck 29 released; that is, the operation of polishing the optical fiber connector 2 is started.

Figure 12:
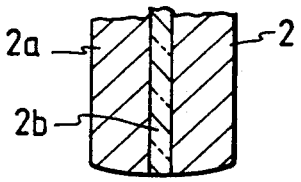
FIG. 12 is an enlarged sectional view of the end portion of the optical fiber connector polished.

The rotation of the motor 16 is transmitted as high speed rotation to the polishing element 4, and is transmitted through the swinging cam 23, the driven rod 25 and the swing lever 35, to the swing fulcrum shaft 31 to rotate the latter in a reciprocation mode. Therefore, the swing arm 5 is repeatedly swung about the swing fulcrum shaft 31 through a predetermined angle. On the other hand, the reciprocating rotation of the motor 30 is transmitted to the chuck 29, so that the optical fiber connector 2 is rotated through about 400° in a reciprocation mode. It is not always necessary to rotate the optical fiber connector about 400° every turn; that is, the following method may be employed: First, the optical fiber connector is rotated through 120° to 180° in a reciprocation mode, and then the angle is gradually increased to 400°. As a result, the optical fiber connector 2 is pushed against the polishing surface of the polishing element 4 in such a manner that it is repeatedly rotated in a reciprocation mode while being repeatedly swung, on the radial line of the polishing element 4, about the swing fulcrum shaft 31. Thus, the conical surface 2*c* of the optical fiber connector 2 is polished into a spherical surface as shown in FIG. 12. During the above-described polishing operation, a suitable polishing solution is applied to the polishing element 4.

The polishing period of time is set by means of a timer or the like in a control device (not shown). Upon completion of the polishing operation, the optical fiber connector 2 is disconnected from the chuck 29, and is optically butt-welded to another optical fiber connector which has been similarly polished.

When the model workpiece is abutted against the upper surface of the reference member 63, the polishing surface is located above the reference surface as much as the protrusion of the model workpiece into the clearance groove 63 formed therein. If this minute difference in height cannot be disregarded, it should be complemented in the polishing operation.

As is apparent from the above description, the specific feature of the invention resides in that the swing arm 5 is made swingable, so that the chuck 29 is confronted with the polishing element 4 when the swing arm comes to its one fixed position, and it is confronted with the regulating means 62 when it comes to the other fixed position. Therefore, the remaining mechanical systems may be replaced with other means; for instance, the rotary drive system may be formed by using gears, etc. The chuck 29, and the swinging motion generating mechanism made up of the cam 23 and the swing lever 35 may be replaced with other mechanisms.

Figure 13:
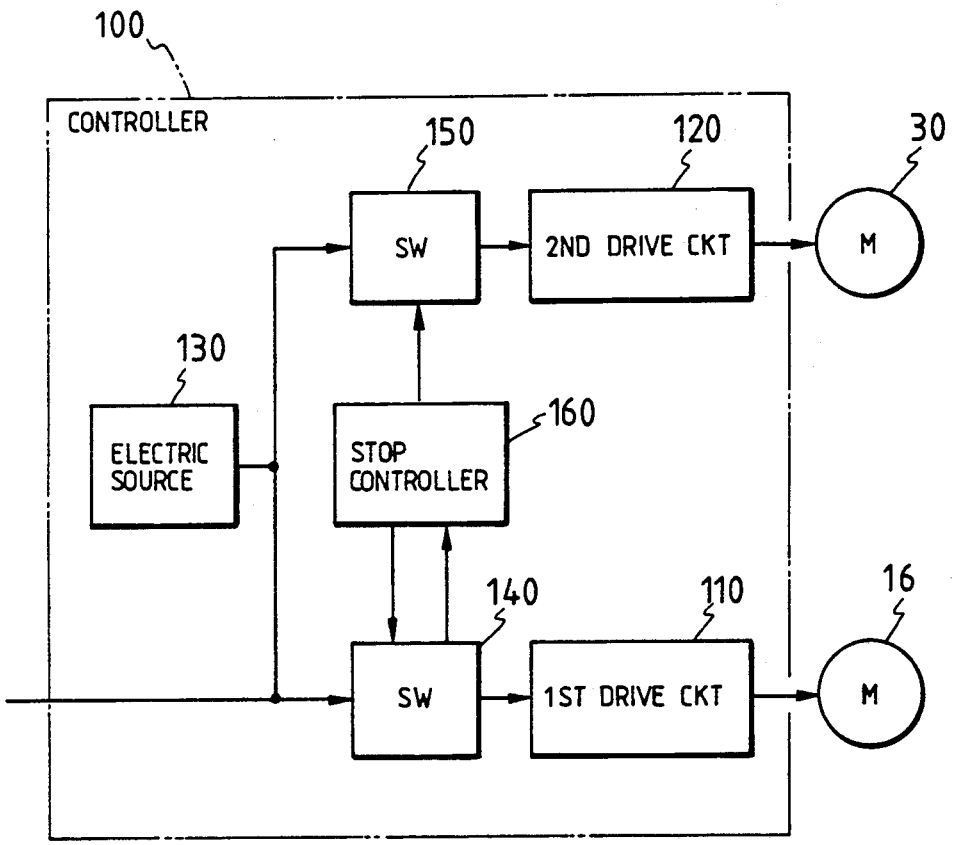
FIG. 13 is a block diagram showing a control circuit for electric motors in the apparatus of the invention.

A control circuit as shown in FIG. 13 may be employed for control of the operations of the motors 16 and 30. In this case, the end face of the optical fiber connector can be finished stably.

When the power switch is turned off, the polishing element 4 is not immediately stopped because of the inertia, whereas the chuck 29 is stopped immediately because its inertial force is small. As a result, the polished end face of the optical fiber connector may be arcuately scratched.

This difficulty may be eliminated by the employment of the control circuit as shown in FIG. 13. In the control circuit, a circuit 110 for driving the motor 16 is operated by operating a switch 140, and a circuit 120 for driving the motor 30 is operating by operating a switch 150. These switches 140 and 150 are connected to a power source 130. Stop control means 160 is provided for the switches 140 and 150. The stop control means has a function of causing the switch 150 to operate in association with the switch 140, and a function of turning off the switches in predetermined periods of time respectively. The predetermined period of time for the switch 140 is a machining period of time, and the predetermined period of time for the switch 140 is slightly longer than the sum of the machining period of time and the time of inertial rotation of the polishing element 4.

The control circuit thus organized will operate as follows: When the switch 140 is manually turned on, the apparatus is started to carry out the polishing operation. In the predetermined period of time, the switch 140 is turned off, and therefore the motor 16 is deenergized, and it will stop upon elimination of the inertial force. However, the switch 150 is held turned on until the motor 26 is stopped in this manner, and accordingly the optical fiber is maintained rotated in a reciprocation mode. The switch 150 is turned off after the polishing element 4 is stopped, so that the optical fiber connector is stopped later. Thus, the employment of the control circuit can positively protect the finished and face of the optical fiber connector from being scratched or damaged.

The invention has the following outstanding effects or merits:

The high-speed rotation of the polishing element, and the reciprocation of the optical fiber connector to be machined are mechanically carried out by only one electric motor, and are synchronous with each other at all times. Therefore, the optical fiber connector polishing apparatus of the invention is stable in operating characteristic and high in machining accuracy.

The drive source for ration may be the commercial electric power source, and the polishing solution may be water. Therefore, with the polishing apparatus of the invention, the end face of an optical fiber connector can be readily polished at the work site or the like.

Furthermore, in the apparatus of the invention, torque is efficiently converted by means of the rational mechanical elements into necessary motions. Therefore, the apparatus is small in size and light in weight, and accordingly can be readily moved to any desired position. Thus, it can be expected that the apparatus of the invention will be employed extensively with the development of optical communications.

When an optical fiber connector to be machined is supported with respect to the swing arm, it is positioned with respect to the polishing surface of the polishing element by means of the reference member. Under this condition, the optical fiber connector is pushed against the polishing element. therefore, the position(height), the radius of the polished spherical surface, and the amount of polishing of the optical fiber connector can be controlled with high accuracy. Accordingly, the end faces of a number of optical fiber connectors can be polished uniformly with high precision.

We claim:

1. An optical fiber connector polishing apparatus comprising:

a chuck for supporting an optical fiber connector in such a manner that said optical fiber connector is rotatable in a clockwise/counterclockwise reciprocation mode;

a swing arm which holds said chuck to swing said chuck, in a horizontal plane, between a first fixed position and a second fixed position;

a reciprocating rotatable motor provided on said swing arm for rotating said chuck in said clockwise/counterclockwise reciprocation mode;

positioning means for positioning said swing arm selectively at said first or second fixed position on a swing locus thereof;

polishing means including a polishing element and rotation means for rotating said polishing element at high speed;

swinging means for swinging said swing arm in a horizontal plane in such a manner that the end of said optical fiber connector swings along a radial direction of the circular rotation of said polishing element and within a radial length thereof continuously while an end portion of said optical fiber connector is being polished with said polishing element; and a reference member for positioning said end portion of said optical fiber connector at a reference position with respect to said chuck, such that said optical fiber connector will be polished to a predetermined length when a polishing operation is conducted with said polishing means, said polishing element being arranged at said first fixed position and said reference member being arranged at said second fixed position of said swing arm, respectively

2. An apparatus as claimed in claim 1, in which said reference member has a reference part which can be moved towards and away from said end portion of said optical fiber connector, and can be fixed at a desired position.

3. An apparatus as claimed in claim 1, in which an angle of rotation of said optical fiber connector in said clockwise/counterclockwise reciprocation mode is at least 360°.

4. An apparatus as claimed in claim 1, in which said swinging means comprises:

worm gear means rotated in association with said rotation means adapted to rotate said polishing element; and cam means reciprocating in association with a rotation of said worm gear means, said cam means for effecting swinging of said swing arm.

5. A method of machining the end portion of an optical fiber connector comprising:

a step of fitting an optical fiber connector in a rotatable chuck coupled to a swingable swing lever;

a step of confronting said optical fiber connector with a reference member, and abutting the end portion of said optical fiber connector against said reference member to determine an amount of protrusion therefor, such that said optical fiber connector will be polished to a predetermined length when a polishing operation is conducted with a polishing element;

a step of swinging said swing arm horizontally to cause said end portion of said optical fiber connector to confront with a polishing element; and a step of rotating said polishing element at high speed, and bringing said end portion of said optical fiber connector into contact with said polishing element while rotating said chuck in a reciprocation mode, to machine said end portion of said optical fiber connector.

6. A method as claimed in claim 5, comprising the further steps of:

a step of stopping the rotation of said polishing element; and a step of stopping the rotation of said chuck at a time which is later than that of said polishing element.

7. A method as claimed in claim 5, in which said chuck is rotated in a reciprocation mode, and said swing arm is swung continuously during a polishing operation using said polishing element.

8. An optical fiber connector polishing apparatus comprising:

a polishing element having a planar and flexible polishing surface, said polishing element being rotatable at a high speed;

a support for supporting an optical fiber connector in such a manner that an end portion of said optical fiber connector is abutted against said polishing surface of said polishing element, said support being horizontally movable, along said polishing surface, in a swinging reciprocation mode along a radial direction of the circular rotation of said polishing element and within a radial length thereof;

a cam member engaged with said support to reciprocate said support;

an optical fiber connector chuck which is rotatably supported on said support, said optical fiber connector chuck for holding said optical fiber connector;

a reference member for positioning an end portion of said optical fiber connector at a reference position with respect to said chuck, such that said optical fiber connector will be polished to a predetermined length when a polishing operation is conducted with said polishing element;

rotating means for rotating said chuck at least 360° in a clockwise/counterclockwise reciprocation mode;

an electric motor coupled to said polishing element and said cam member, said electric motor being for rotatably driving said polishing element and said cam member; and speed reducing means interposed between said cam member and said electric motor for rotating said polishing element in a speed higher than said swinging speed in the reciprocation mode of said support.

* * * * *